United States Patent [19]

Manola

[11] Patent Number: 4,599,163

[45] Date of Patent: Jul. 8, 1986

[54] DEVICE FOR THE SEPARATION OF THE COMPONENTS OF EDIBLE MEAL

[75] Inventor: Umberto Manola, Brescia, Italy

[73] Assignee: The Proteins Technology S.p.A., Campobasso, Italy

[21] Appl. No.: 612,829

[22] Filed: May 22, 1984

[30] Foreign Application Priority Data

Jun. 3, 1983 [IT] Italy ..... 12539 A/83

[51] Int. Cl.[4] ..... B07B 11/06

[52] U.S. Cl. ..... 209/139 A; 209/138; 209/146; 209/148

[58] Field of Search ..... 209/146–150, 209/144, 152, 153, 139 A, 139 R, 138; 55/459 B, 459 D

[56] References Cited

U.S. PATENT DOCUMENTS

| | | | |
|---|---|---|---|
| 538,310 | 4/1895 | Zerener | 209/148 |
| 1,385,025 | 7/1921 | Startevant | 209/139.2 |
| 2,125,086 | 7/1938 | Rourke | 209/144 |
| 2,329,299 | 9/1943 | Rourke | 209/144 |
| 3,483,973 | 12/1969 | Jager | 209/144 |
| 3,615,008 | 10/1971 | Alpha | 209/144 |
| 3,643,800 | 2/1972 | Mansson | 209/148 |
| 4,221,655 | 9/1980 | Nakayama | 209/144 |

FOREIGN PATENT DOCUMENTS

| | | | |
|---|---|---|---|
| 178590 | 10/1953 | Austria | 209/144 |
| 580136 | 7/1958 | Italy | 209/144 |
| 2061770 | 5/1981 | United Kingdom | 209/148 |

*Primary Examiner*—S. Leon Bashore
*Assistant Examiner*—William Bond
*Attorney, Agent, or Firm*—Pollock, Vande Sande & Priddy

[57] ABSTRACT

Separator device for edible meal, comprising a vertical cylindrical container (4) provided at its the bottom with a discharge rotary valve (9). A feeding duct (5) extends axially into the top portion of the container, and swirling means are provided so that the meal to be treated will reach with a whirling flow the central portion of a distributing chamber (31) having equispaced lateral openings (32) from which equal spiral-shaped tubes (33) protrude outwards with the same curvature, whereby the meal is discharged tangentially onto the periphery of an underlying horizontal dish (6) which is arranged co-axially in the upper portion of the container (4). Arranged at a suitable distance above the disc there is a horizontal partition (1) which is fixed to the container and is sealingly traversed by the curved feeding tubes (33). At the center of the disc (6) there is formed an opening (10) connected to an underlying duct (11) which is sealingly passed outwards through the container (4) and is connected to a suction source. Inside the container (4) below the disc (6) there opens one conduit (15) communicating with the atmosphere.

5 Claims, 4 Drawing Figures

DEVICE FOR THE SEPARATION OF THE COMPONENTS OF EDIBLE MEAL

FIELD OF THE INVENTION

The present invention relates to a device for physically separating the components of edible meal.

BACKGROUND OF THE INVENTION

Methods are known of separating into different amounts having different proteir contents, meals to be used as edible or as chemical-pharmaceutical products, said methods being based on air classification of the product, wherein the parts to be separated are placed in a series of cyclone separators which are serially traversed by the air entraining the product and are each provided, in the lower part thereof, with star-type rotary valves for continuous discharge of the amounts of precipitated product. The plants designed heretofore to carry this method into effect are of complicated construction, of difficult adjustment, of difficult adaptation and they are subject to so many inconveniences and drawbacks in their operation as to be unqualified for use on an industrial scale. In the known plants, the product is circulated through the various separators by a flow of pressurized air generated by an electric fan or similar device located upstream of the plant. These devices are, notoriously, sources of heat and, due to their location, they transfer said heat to the entire plant and, therefore, to the product so as to inevitably modify it as to nutritive capacity and/or other characteristics thereof. Meals discharged by the known plants, in fact, are characterized by a much darker shade than the meals originally fed to the plant.

SUMMARY OF THE INVENTION

This invention proposes a plant for the pneumatic separation of meal components, adapted to operate with a reduced power input and to obviate all said drawbacks, thanks to the fact that:

- it utilizes new separator devices permitting an accurate separation of the components of the meal;
- the circulation of the product through the various operative units of the plant is caused by the suction exerted by a compressor which is connected with its suction mouth to the last unit of the plant. The air circulating in the plant, therefore, is not a source of appreciable increase of temperature, because the heat produced by the compressor is downstream of the entire plant and may be easily dissipated by means of simple provisions;
- the compressor is preferably of the volumetric type, thereby ensuring a repetitive and constant operation of the plant.

BRIEF DESCRIPTION OF THE DRAWINGS

The characteristic features of the separator device and plant according to the invention, and the advantages resulting therefrom, will be apparent from the following description of a preferred embodiment of same, made, by way of non-limiting example, with reference to the attached drawings, in which.

DESCRIPTION OF THE PREFERRED EMBODIMENT

Figure 1:
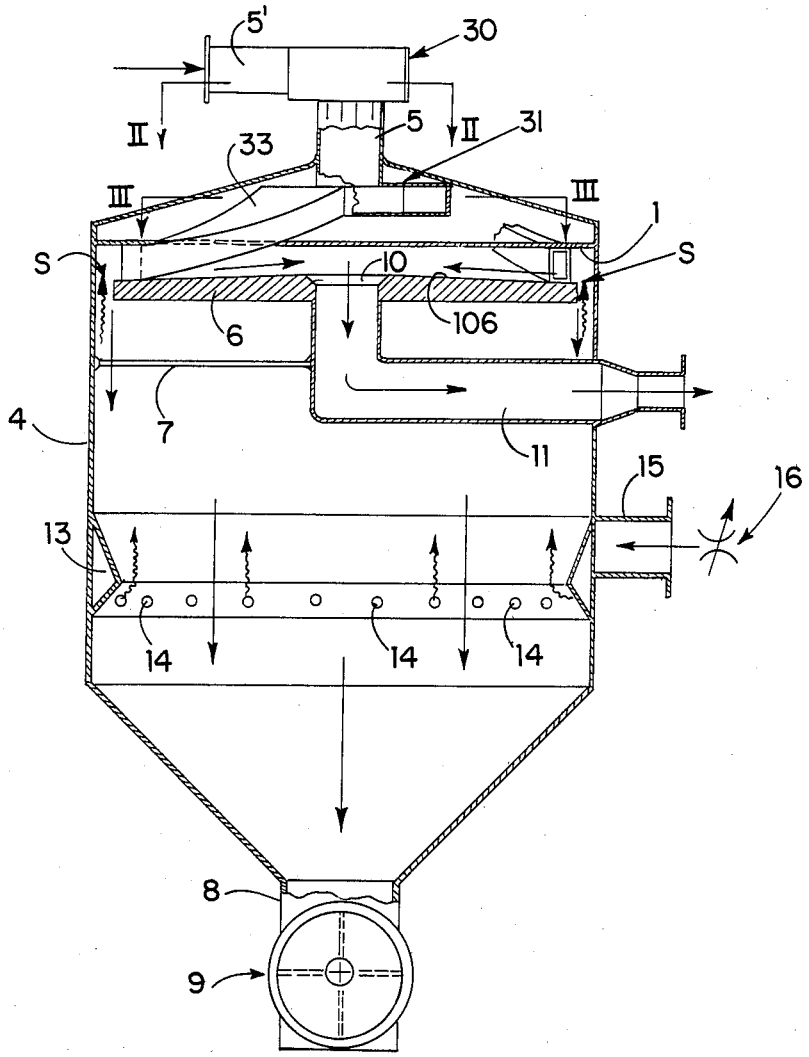
FIG. 1 is a side axial sectional view of a separator device according to the invention.

With particular reference to FIG. 1, the separator device comprises a vertical container 4 which is preferably of cylindrical shape and round section, closed at its top and at its bottom. The container 4 has a tapering bottom and is provided with a discharge conduit 8 closed by a rotary valve 9 of the so-called star type. In the intermediate lower portion of the container 4, above the discharge conduit 8, there is provided an annular manifold collector 13 presenting a plurality of downwardly directed openings 14 and connected to at least one conduit 15 opening to the atmosphere under the control of valve means 16 which for example consist of a suitable variable restrictor.

Arranged co-axially in the upper portion of the container 4, there is a horizontal disc 6 having an upper face 106 which is highly polished and is of conical shape with a suitably downwardly diverging contour. A round opening 10 is formed centrally of said disc and communicates with an underlying duct 11 sealingly extending outwards through said container 4 and connected to a suitable suction source (see below). The disc 6 is of circular configuration and its edge is suitably spaced from the inner side face of the container 4 so as to form therebetween an annular space S of suitable width. A bracing structure for the assembly 6-11 is indicated by the numeral 7. Due to the suction exerted through the duct 11 and to the presence of the parts 13-14-15-16, an upward air stream of suitable characteristics is generated in the container 4 and travels through said annular space S before lapping the upper surface of the disc 6 and reaching the opening 10.

Figure 2:
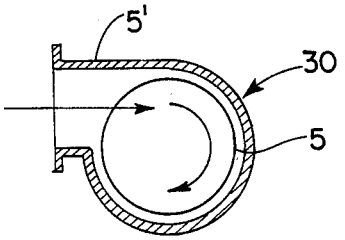
FIG. 2 is a horizontal section along line II—II of FIG. 1.
Figure 3:
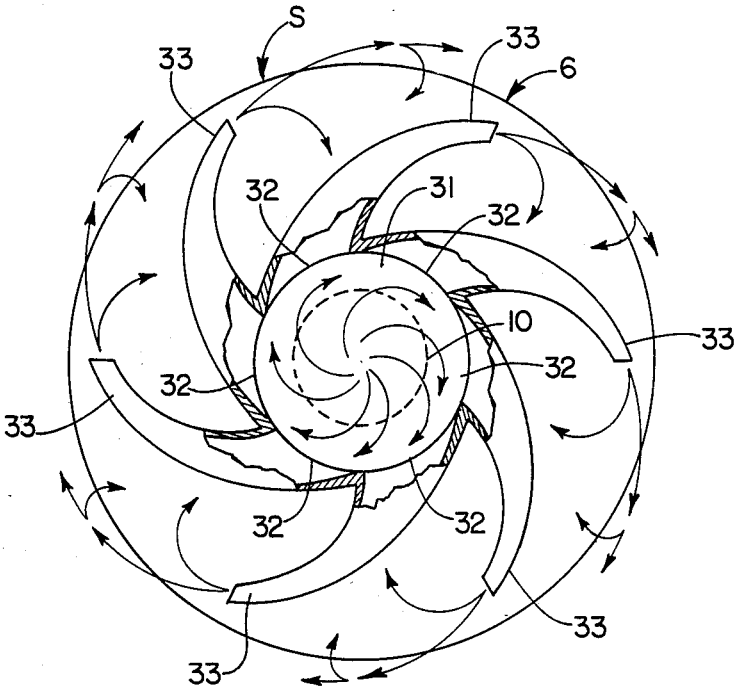
FIG. 3 is a horizontal section, in the downward direction, with some parts broken away, of a detail along line III—III of FIG. 1.

The product (meal) to be treated, is fed into the separator device from the top of the container 4, through a vertical feeding duct 5. With reference also to FIG. 2, it is to be noted that the product reaches the said vertical feeding duct 5 by passing through a horizontal duct 5' perpendicularly arranged with respect to the vertical duct 5 and through suitable swirling means consisting of a scroll member 30, so that the product will enter into the vertical feeding duct 5 with a swirling flow. The lower end of the duct 5 is secured to the central circular opening formed in the upper wall of a round-section cylindrical chamber 31 arranged horizontally and coaxially in the container 4 and operating as a manifold distributor. In fact, the side wall of said chamber is provided with equal and angularly equi-spaced openings 32, and as many equal angularly equi-spaced tubes 33 are fixed thereto, by one of their ends, said tubes being curved like the initial portion of an Archimedean spiral, being all directed in the same direction and having all the same curvature. The free ends of said tubes 33 terminate on the periphery of the disc 6 at angularly equi-spaced points of the latter and, preferably, they lie on respective imaginary planes passing through the center of the disc 6 so that the product will be discharged from said tubes substantially tangentially to the ideal circumference on which the free ends of the tubes 33 lie.

Above the disc 6 there is arranged a horizontal diaphragm or partition 1 which is traversed in an airtight manner by said tubes 33 and is secured to the side surface of the container 4. Preferably, the undersurface of the partition 1 is highly polished and is in contact with the free ends of the tubes 33. The section of each tube 33, from the base to the free end thereof, is of decreasing width, whereas its height may be either constant or variable. Anyway, it is to be understood that the tubes 33 may present a section other than the rectangular section shown in the drawing and may be of different size from that mentioned above.

The separator device described above operates as follows. Due to the suction exerted in the container 4 through the duct 11, the product enters the distributor 31 with whirling motion and flows out therefrom divided into equal streams through the openings 32 and tubes 33. The product is thus distributed uniformly onto the periphery of the disc 6. Each stream outflowing from a tube 33 can travel along a sufficiently long horizontal path between the members 6 and 1, so that it can be effectively separated by the air stream being sucked through the duct 11. The lighter particles of the product, therefore, are swiftly sucked through said duct 11, whereas the heavier particles, having a greater kinetic energy, proceed centrifugally along their path, go beyond the periphery of the disc 6 and reach the annular space S. Here, the product is further separated: the heavier particles fall onto the bottom of the container 4, whereas the lighter particles follow the upward air stream back into the space between the members 1 and 6 and are entrained away by the suction effect. Is is also to be noted that during the travel from the distributor 31 to the disc 6, which is at a lower level, and during the travel in the curved tubes 33, the product tends to separate into streams of different granulometry due to the greater kinetic energy of the heavier particles. This condition also facilitates the pneumatic selection or separation to which the product will be subjected upon leaving the tubes 33.

It is to be understood that many changes and modifications, particularly of a constructional nature, may be made to the device described above. The undersurface of disc 6 may be suitably shaped, for example conically upwardly diverging, in order to avoid turbulence. The disc 6 may be provided at its periphery with suitably-inclined cutouts to force the upward air stream lapping the disc to follow a helical path. Suitable baffles may also be provided for this purpose under the disc 6. In order to avoid the formation of any unbalancing turbulence in the space S, the horizontal portion of the duct 11 may be located at a greater distance from said space, or even below the manifold collector 13. To improve the distribution of the product into the openings 32 of the chamber 31, an impeller such as those used with centrifugal blowers can be provided axially rotatably mounted in said chamber and may be suitably rotated axially. Alternately, the assembly 31-33-1 may be rotated around its axis.

The tubes 33 may be in a number different from that of the illustrated embodiment, and their configuration and size may also be different.

Figure 4:
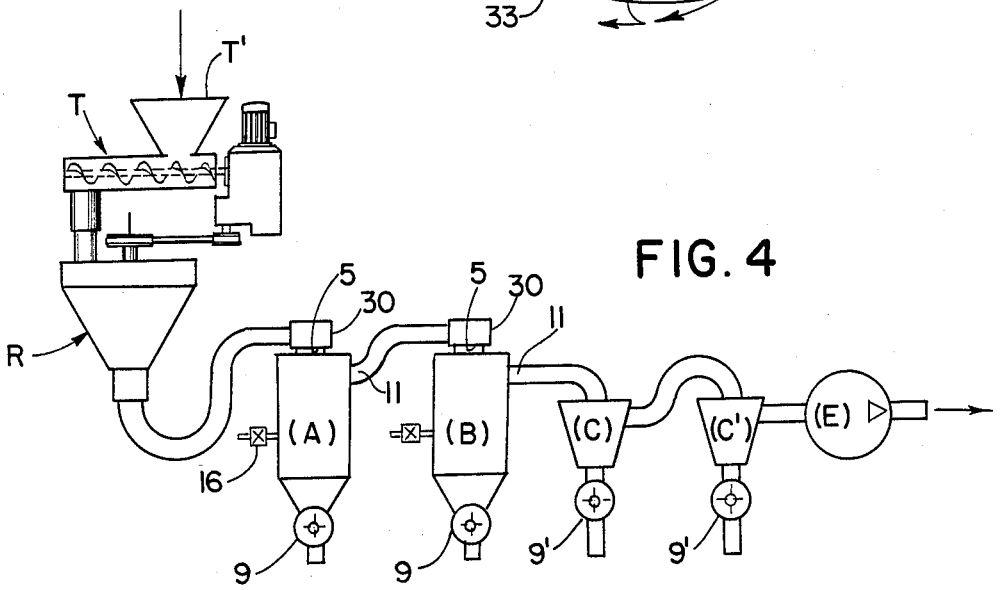
FIG. 4 is a diagrammatic view of a plant for the separation of the components of meal, by using the separator devices of the type shown in FIG. 1.

FIG. 4 is a diagrammatic illustration of a plant utilizing separator devices of the type described above to separate cereal meal into fractions of different granulometry and different protein contents. The plant comprises at leat two serially-connected separator devices A and B of the type as illustrated in FIG. 1, which constitute the first section of said plant, and comprises finally one or more cyclone separators C-C', preferably of entirely conical type, provided with respective discharge rotary valves 9'. The last cyclone C' is connected to the suction side of at least one compressor E having suitable characteristics, and preferably of the volumetric type so as to ensure a constant operation of the plant. The product passes successively through the units A-B-C-C' wherein it precipitates according to an increasing order of fineness, i.e., the unit A collects the heaviest particles and the unit C' collects the lightest or finest particles. The air discharged from the compressor E contains no product; anyway, it is filtered for absolute anti-acoustical and anti-pollution purposes. The product is circulated through the plant by suction effect, and not by blowing effect as in the conventional installations, whereby the product will not be damaged by the heat produced by the compressor E. The product is fed to the plant by any means capable of effecting a controlled feeding of said product, such as a screw feeder T provided with a loading hopper T'. A meal refining unit R may be provided, if desired, between these feeding means and the spearator device. Satisfactory results, also from the standpoint of energy saving, have been obtained by the use of a small grinder with rotating or counter-rotating knives.

I claim:

1. A separator device for separating the components of edible meal, comprising (a) a cylindrical container (4) of round cross section, having at its bottom a discharge duct (8);

(b) a round horizontal disc (6) within said container having a peripheral edge of a predetermined thickness and having a conical downwardly diverging upper surface, said disc (6) being provided with a central opening (10) connected to a duct (11) which extends sealingly outwards through said container (4) and is connected to a suction source said disk peripheral edge and said container defining therebetween a first vertical separation region;

(c) a distributor comprising a cylindrical casing (31) arranged co-axially at the top of said container (4), said casing (31) being provided at its top with a central opening through which said meal components are fed, and being provided on its cylindrical side wall with substantially equal and equi-spaced openings (32) from which project identical and equi-spaced tubes (33) curved like the initial portion of an Archimedean spiral and all extending in the same direction, free ends of said tubes upon said disk so as to discharge the meal tangentially onto a peripheral zone of said disc (6);

(d) swirling means (30) in a feeding duct (5, 5') for said meal, whereby said meal is fed to the casing (31) of said distributor with a swirling flow;

(e) a horizontal partition (1) arranged above said disc (6) and secured to an inner side wall of said container (4), said partition (1) being traversed in airtight manner by said tubes (33) projecting from said feeding distributor (31), the undersurface of said partition (1) being in contact with the free ends of said tubes (33) above said disk periphery so as to form a second horizontal separation zone; and (f) an annular manifold (13) located below said disc (6) and coaxial therewith, and connected to at least one duct (15) opening to the atmosphere through the intermediary of a valve means (16), whereby, as a result of the suction exerted in said cylindrical container (4) by said suction source, an upward air stream is formed therein which laps the peripheral portion of said disc (6) onto which said meal is discharged and permits heavier particles of said meal to precipitate while it holds lighter particles thereof suspended to be entrained by the suction air stream, whereby, due to said distributor chamber (31) to which said meal is fed with a swirling flow, and to said tubes (33) projecting from said chamber (31), said meal is distributed uniformly onto the periphery of said disc (6) where it undergoes a first effective separation in said second separation zone by action of said air stream which is sucked through said central opening (10) of said disc (6) and thus entrains the lighter particles, while the heavier particles continue their centrifugal motion and go beyond the disc where they are subjected to a further separation in said first separation zone by the action of said upward air stream.

2. A device according to claim 1, wherein the swirling means which promotes the swirling of the meal being fed into the said distributor chamber (31) consist of a scroll member (30).

3. A device according to claim 1, wherein the spiral-shaped tubes (33) projecting from the distributor 31 have a polygonal, preferably rectangular, cross section.

4. A device according to claim 1, wherein the said tubes (33) projecting from the distributor have a section that, from their attachment to the distibutor, to the free end of each tube, is of decreasing width but of constant height.

5. A device according to claim 1, wherein the free ends of said spiral-shaped tubes (33) from the distributor (31) lie on imaginary, preferably vertical planes passing through the central axis of the underlying disc (6).

* * * * *